United States Patent [19]

Pike et al.

[11] Patent Number: 4,955,356

[45] Date of Patent: Sep. 11, 1990

[54] ARCHERY BOW STABILIZER AND TRACKER

[76] Inventors: Michael L. Pike, 5145 Keyes Dr.; William A. McCormick, 5113 E. D. E Ave., both of Kalamazoo, Mich. 49004

[21] Appl. No.: 436,694

[22] Filed: Nov. 15, 1990

[51] Int. Cl.[5] ..... F41B 5/00

[52] U.S. Cl. ..... 124/89; 124/88

[58] Field of Search ..... 124/23 R, 24 R, 86, 124/88, 89

[56] References Cited

U.S. PATENT DOCUMENTS

| | | | |
|---|---|---|---|
| 2,817,919 | 12/1957 | Cress | 124/88 X |
| 3,377,999 | 4/1968 | Reynolds | 124/88 X |
| 3,589,350 | 6/1971 | Hoyt, Jr. et al. . | |
| 4,245,612 | 1/1981 | Finlay | 124/89 |
| 4,378,781 | 4/1983 | Shiflett | 124/88 X |
| 4,491,123 | 1/1985 | Wirtz | 124/89 |
| 4,570,608 | 2/1986 | Masterfield | 124/89 |
| 4,615,327 | 10/1986 | Saunders | 124/89 |
| 4,633,846 | 1/1987 | Ipock | 124/23 R |
| 4,744,347 | 5/1988 | Dodge | 124/86 |

OTHER PUBLICATIONS

Saunders Archery advertisement, "Bow and Arrow", Oct. 1985, p. 19.

*Primary Examiner*—Randolph A. Reese
*Assistant Examiner*—John A. Ricci
*Attorney, Agent, or Firm*—Jerry T. Kearns

[57] ABSTRACT

A combined stabilizer and tracker for attachment to an archery bow has first and second threadably connectable body members. An additional weight may be afforded through the use of a threaded extension member. The second body member may be utilized with a removable bushing to allow use of a variety of standard archery tracking cords. The device may be employed as a combined stabilizer and tracker, or utilized solely as a stabilizer. The archery bow stabilizer and tracker is preferably formed from a corrosion resistant brass material and eliminates the need for separate stabilizing and arrow tracking devices.

11 Claims, 3 Drawing Sheets

ARCHERY BOW STABILIZER AND TRACKER

BACKGROUND OF THE INVENTION

1. Field of the Invention

The present invention relates to archery bow stabilizers and trackers, and more particularly pertains to a combined bow stabilizer and tracking device which eliminates the need for separate bulkY and cumbersome stabilizing and tracking devices.

2. Description of the Prior Art

Various types of archery bow stabilizers and trackers are known in the prior art. A typical example of such an archery bow stabilizer is to be found in U.S. Pat. No. 3,589,350, which issued to E. Hoyt, Jr. on June 29, 1971. This patent discloses an adjustable stabilizer having an elongated telescopically adjustable support for supporting a waiting element in selective spaced relationship with a bow. U.S. Pat. No. 4,245,612, which issued to R. Finlay on January 20, 1981, discloses an archery bow stabilizer including spring biased weight elements and a scent emitting mechanism. U.S. Pat. No. 4,491,123, which issued to G. Wirtz on Jan. 1, 1985, discloses an archery bow stabilizer having a pivotal mounting bracket. U.S. Pat. No. 4,615,327, which issued to C. Saunders on Oct. 7, 1986, discloses a two staged resiliently mounted stabilizer adapted for connection to an archery bow. U.S. Pat. No. 4,633,846, which issued to W. Ipock on Jan. 6, 1987, discloses a combined archery bow stabilizer and detachable hunting knife.

While the above mentioned devices are directed to archery bow stabilizers, none of these devices disclose a combined archery bow stabilizer and arrow tracking device. Inasmuch as the art is relatively crowded with respect to these various types of archery bow stabilizer and trackers, it can be appreciated that there is a continuing need for and interest in improvements to such archery bow stabilizer and trackers, and in this respect, the present invention addresses this need and interest.

SUMMARY OF THE INVENTION

In view of the foregoing disadvantages inherent in the known types of archery bow stabilizer and trackers now present in the prior art, the present invention provides an improved archery bow stabilizer and tracker. As such, the general purpose of the present invention, which will be described subsequently in greater detail, is to provide a new and improved archery bow stabilizer and tracker which has all the advantages of the prior art archery bow stabilizer and trackers and none of the disadvantages.

To attain this, representative embodiments of the concepts of the present invention are illustrated in the drawings and make use of a combined stabilizer and tracker for attachment to an archery bow which has first and second threadably connectable body members. An additional weight may be afforded through the use of a threaded extension member. The second body member may be utilized with a removable bushing to allow use of a variety of standard archery tracking cords. The device may be employed as a combined stabilizer and tracker, or utilized solely as a stabilizer. The archery bow stabilizer and tracker is preferably formed from a corrosion resistant brass material and eliminates the need for separate stabilizing and arrow tracking devices.

There has thus been outlined, rather broadly, the more important features of the invention in order that the detailed description thereof that follows may be better understood, and in order that the present contribution to the art maY be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generallY and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery bow stabilizer and tracker which has all the advantages of the prior art archerY bow stabilizer and trackers and none of the disadvantages.

It is another object of the present invention to provide a new and improved archery bow stabilizer and tracker which may be easily and efficiently manufactured and marketed.

It is a further object of the present invention to provide a new and improved archery bow stabilizer and tracker which is of a durable and reliable construction.

An even further object of the present invention is to provide a new and improved archery bow stabilizer and tracker which is susceptible of a low cost of manufacture with regard to both materials and labor, and which accordingly is then susceptible of low prices of sale to the consuming public, thereby making such archery bow stabilizer and trackers economically available to the buying public.

Still yet another object of the present invention is to provide a new and improved archery bow stabilizer and tracker which provides in the apparatuses and methods of the prior art some of the advantages thereof, while simultaneously overcoming some of the disadvantages normally associated therewith.

Still another object of the present invention is to provide a new and improved archery bow stabilizer and tracker which combines a stabilizer and arrow tracking device into a single integral unit.

Yet another object of the present invention is to provide a new and improved archery bow stabilizer and tracker which is adaptable for use with a variety of standard arrow tracking cords.

Even still another object of the present invention is to provide a new and improved archery bow stabilizer and tracker which may be selectively utilized as a stabilizer, or as a combined stabilizer and arrow tracking device.

These together with other objects of the invention, along with the various features of noveltY which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
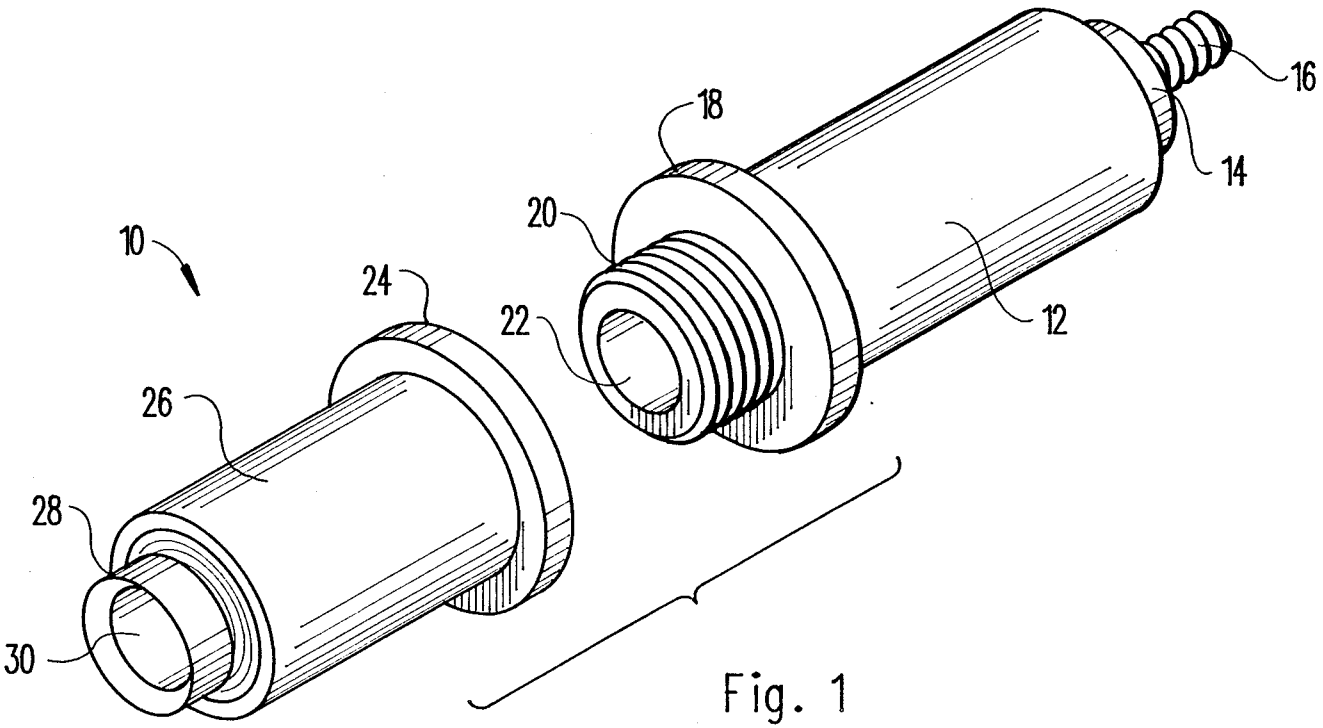
FIG. 1 is an exploded perspective view illustrating the archery bow stabilizer and tracker of the present invention.

With reference now to the drawings, and in particular to FIG. 1 thereof, a new and improved archery bow stabilizer and tracker embodying the principles and concepts of the present invention and generally designated by the reference numeral 10 will be described.

More specifically, it will be noted that the first embodiment 10 of the invention includes a first elongated cylindrical body member 12 having a central cylindrical bore 22 formed partiallY therethrough. A threaded shaft 16 extends from a boss 14 at a first end of the body 12. The threaded shaft 16 is adapted for threaded connection in a threaded aperture provided in a conventional archery bow. A radial flange 18 surrounds an externally threaded portion 20 at a second end of the body 12, opposite the shaft 16. A second hollow cylindrical body member 26 has a radial flange 24 surrounding an internally threaded connection portion configured for engagement with the externally threaded member 20. Upon assembly, the radial flanges 18 and 24 will be disposed in aligned abutment. A reduced diameter neck portion 28 extends from an end of the second body member 26 opposite the flange 24. A central reduced diameter bore portion 30 is formed therethrough.

Figure 2:
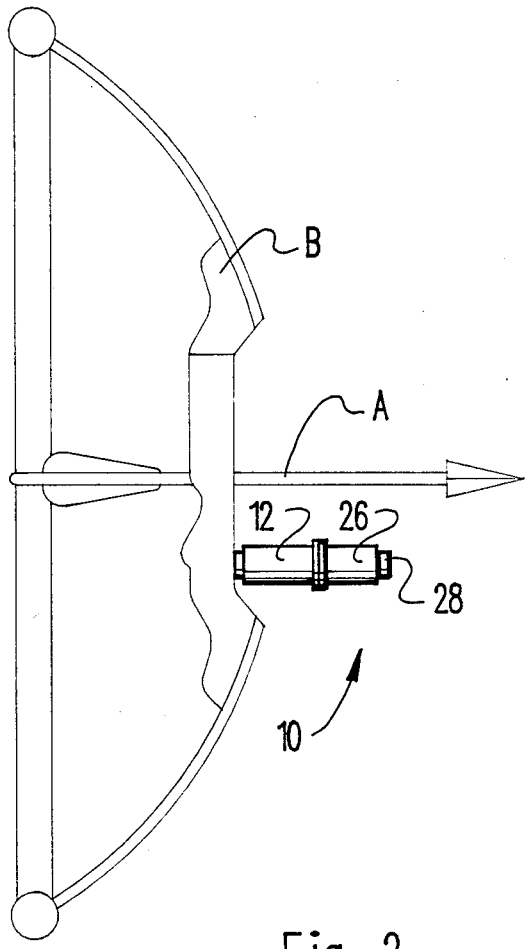
FIG. 2 is a side elevational view illustrating the archery bow stabilizer and tracker of the present invention as installed on a conventional bow.

As shown in FIG. 2, the assembled first 12 and second 26 body members are adapted for connection to a front surface of a conventional archerY bow B. The body members 12 and 26 are preferably formed from a dense metal material such as brass to provide an inertial stabilizing effect to enhance accuracY. Additionally, the hollow interior of the body members 12 and 26 allow the use of a conventional spool or coil of an arrow tracking cord. The end of the tracking cord is secured to the arrow A in a conventional manner. Upon release of the arrow A, the tracking cord gradually plays out through the open end 28 of the bodY member 26, and tracks the flight of the arrow A for subsequent retrieval.

Figure 3:
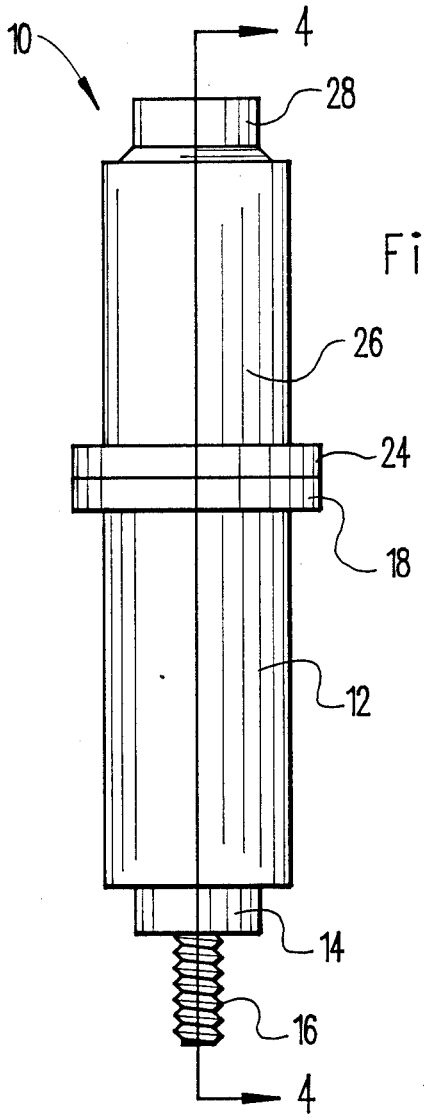
FIG. 3 is a side view of the archerY bow stabilizer and tracker of the present invention.

FIG. 3 is a side view which illustrates the assembled stabilizing and tracking device 10 of the present invention. The abutting aligned radial flanges 18 and 24 serve to provide a concentration of mass at a sufficient distance from the mounting shaft 16 to provide an inertial moment arm to counter-act the natural rotational tendency of the bow upon release of the drawn bow string.

Figure 4:
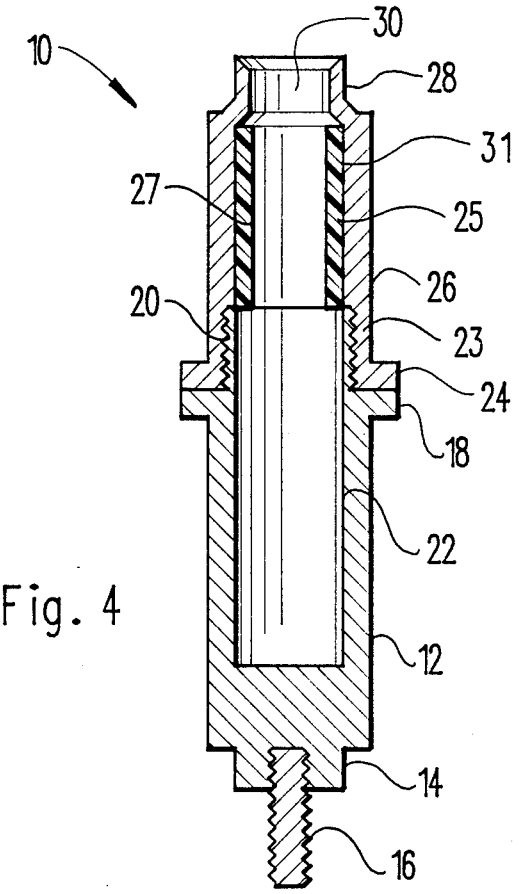
FIG. 4 is a longitudinal cross sectional view, taken along line 4—4 of FIG. 3.

As shown in FIG. 4, the reduced diameter bore 30 tapers to an enlarged central cylindrical bore 31 formed through the second body member 26. A similar bore 22 is formed partially through the first body member 12, in coaxial alignment with the bore 31. A nylon bushing 25 has a reduced diameter bore 27 to allow use of a variety of different standard arrow tracking cords. While the various components of the stabilizer and tracking device of the present invention may be formed in a variety of different dimensions, preferred dimensions are as hereinafter described. The outer diameter of the first 12 and second 26 bodY members is preferablY about 1 and ¾inches. The radial flanges 18 and 24 have a diameter of about 2 inches. The aligned bores 31 and 22 have a diameter of about 1.5 inches. The bushing 25 has an outer diameter of about 1.498 inches and an inner diameter of the bore 27 at about 1.135 inches. The reduced diameter bore 30 has a diameter of about 15/32 of an inch. The bore 31 has a preferred length of about 1 and ⅛inches, while the bore 22 has a length of about 2 and 1/16 inches. These various preferred dimensions allow the use of four standard sizes of conventionally available arrow tracking strings or cords. The reduced diameter bore 30 is also dimensioned for insertion of standard arrow tracker retaining corks. By removing the second body member 26 from engagement with the first body member 12, the device may be selectively utilized as only a stabilizer. Similarly, the second body member 26 may be attached to afford an additional stabilizing weight, while not requiring the use of an arrow tracking cord. The second body member 26 may be utilized with or without the bushing 25, depending upon the particular arrow tracking cord spool size employed.

Figure 5:
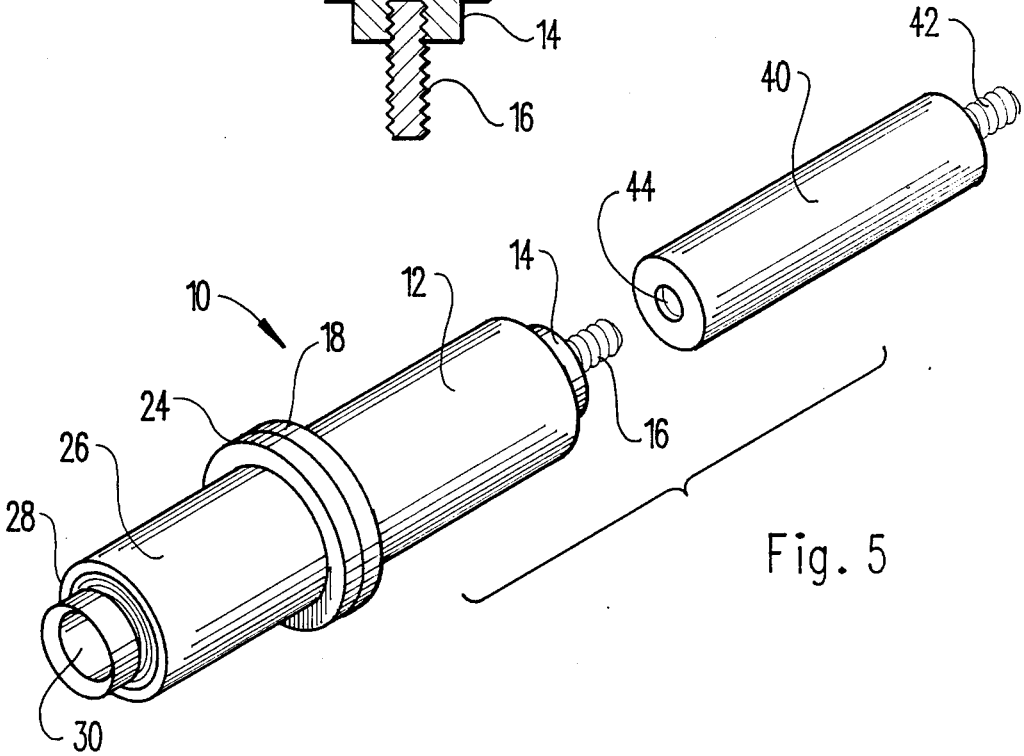
FIG. 5 is an exploded perspective view illustrating the use of an optional extension member.

FIG. 5 illustrates the use of an elongated cylindrical extension member 40 which has a threaded stub portion 42 extending from a first end for engagement with an archery bow and a central threaded bore 44 at an opposite end for connection with the threaded shaft 16 of the first body member 12. This allows an additional inertial stabilizing mass to be added as required, for example with bows of heavy draw weights.

As may now be understood, the present invention provides an arrow tracking and inertial stabilizing device which may be selectively employed for solely stabilizing purposes. The device is readily adaptable for use with various different standard sized arrow tracking cord, coil or spool sizes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. An archery bow tracker and stabilizer, comprising:
a first elongated cylindrical body member;
a first central cylindrical bore formed in said first body member;
a threaded shaft at a first end of said first body member for connection to an archery bow;
a threaded member at a second end of said first body member;
a first radiused flange surrounding said threaded member;
a second elongated cylindrical body member;
a cooperating threaded member at a first end of said second body member for engagement with said threaded member;
a second cylindrical bore formed through said second body member in coaxial alignment with said first bore in said first body member;
a second radial flange surrounding said complementary threaded member and dimensioned for abutment with said first radial flange; and
said second cylindrical bore tapering to a reduced diameter adjacent a second end of said second body member.

2. The archery bow stabilizer and tracker of claim 1, further comprising an extension member having a first end provided with a threaded bore for engagement with said threaded shaft of said first body member and a second end having a threaded stub portion for engagement with an archery bow.

3. The archery bow stabilizer and tracker of claim 1, further comprising a bushing having a reduced diameter bore removably received in said second body member.

4. The archery bow stabilizer and tracker of claim 1, wherein said first and second body members are formed from a dense metal material.

5. The archery bow stabilizer and tracker of claim 1, wherein said first and second body members are formed from brass.

6. An archery bow stabilizer and tracker, comprising:
a first body member;
a first central cylindrical bore formed in said first body member;
means at a first end of said first body member for engagement with an archery bow;
a second body member;
a second central cylindrical bore formed in said second body member;
abutting first and second radial flanges on said first and second body members;
and
means for securing said second body member to a second end of said first body member, opposite said first end.

7. The archery bow stabilizer and tracker of claim 6, further comprising an extension member with a first end having a means for engagement with said first end of said first body member and means at a second end of said extension member for engagement with an archery bow.

8. The archery bow stabilizer and tracker of claim 6, further comprising a bushing having a reduced diameter bore removably received in said second body member.

9. The archery bow stabilizer and tracker of claim 6, wherein said second central cylindrical bore tapers to a reduced diameter adjacent a second end of said body member.

10. The archery bow stabilizer and tracker of claim 6, wherein said first and second body members are formed from a dense metal material.

11. The archery bow stabilizer and tracker of claim 6, wherein said first and second body members are formed from brass.

* * * * *